US007135096B2

(12) United States Patent
Despault et al.

(10) Patent No.: US 7,135,096 B2
(45) Date of Patent: Nov. 14, 2006

(54) PRESS FELT WITH IMPROVED DEWATERING CAPABILITY

(75) Inventors: Marc P. Despault, Ottawa (CA); Brady S. Patterson, Kanata (CA)

(73) Assignee: AstenJohnson, Inc., Charleston, SC (US)

( * ) Notice: Subject to any disclaimer, the term of this patent is extended or adjusted under 35 U.S.C. 154(b) by 110 days.

(21) Appl. No.: 10/918,031

(22) Filed: Aug. 12, 2004

(65) Prior Publication Data

US 2005/0133185 A1 Jun. 23, 2005

Related U.S. Application Data

(60) Provisional application No. 60/532,194, filed on Dec. 23, 2003.

(51) Int. Cl.
*D21F 7/08* (2006.01)
*B32B 5/08* (2006.01)
*B32B 5/26* (2006.01)

(52) U.S. Cl. ..... 162/358.2; 162/900; 442/270; 442/271; 442/274; 442/275; 442/324; 442/329; 442/361; 442/383; 442/388; 442/392; 442/407; 442/415

(58) Field of Classification Search ..... 162/116, 162/117, 205, 206, 358.1, 358.2, 348, 900, 162/902, 903, 904; 139/383 A, 425 A, 383 AA; 442/182, 268, 270–275, 301, 328, 329, 381, 442/383, 389, 392, 402, 403, 407, 414, 415, 442/320–326, 388, 361
See application file for complete search history.

(56) References Cited

U.S. PATENT DOCUMENTS 3,392,079 A * 7/1968 Fekete ..... 428/113
4,162,190 A * 7/1979 Ashworth ..... 162/358.2
4,323,622 A 4/1982 Gladh et al.
4,439,481 A * 3/1984 Johnson et al. ..... 442/271
4,520,059 A * 5/1985 Worrall et al. ..... 428/109
4,529,643 A 7/1985 Lundstrom
4,781,967 A * 11/1988 Legge et al. ..... 428/109

(Continued)

FOREIGN PATENT DOCUMENTS

EP 1 413 673 4/2004

(Continued)

OTHER PUBLICATIONS

Wahlstrom, B., 1960. *A Long Term Study of Water Removal and Moisture Distribution on a Newsprint Machine Press Section*. Paper presented at 46th Annual Meeting Technical Section, Canadian Pulp and Paper Association (Montreal, QC, Jan. 26-29, 1960), pp. 271-327.

(Continued)

*Primary Examiner*—Eric Hug
(74) *Attorney, Agent, or Firm*—Volpe and Koenig, PC

(57) ABSTRACT

A press felt for use in the press section of a papermaking machine is provided. The press felt includes a base fabric layer and at least one layer of a staple fiber batt material connected thereto. The staple fiber batt material is includes between 20% to 100% by weight of a regenerated cellulosic staple fiber material, such as rayon, and from 80% to 0% by weight of a polymeric staple fiber, such as nylon. A scrim including regenerated cellulosic material can also be incorporated into the press felt construction, either between two layers of batt material, or between a batt layer and the base fabric. The regenerated cellulosic staple fibers of the batt and/or scrim having a dtex from at least about 1.1 to about 44, and are preferably non-fibrillatable. As a further option, at least a portion of the base fabric includes a regenerated celluliosic material.

21 Claims, 1 Drawing Sheet

U.S. PATENT DOCUMENTS

| | | | |
|---|---|---|---|
| 5,135,802 | A | 8/1992 | Gstrein et al. |
| 5,204,171 | A | 4/1993 | Eschmann |
| 5,232,768 | A | 8/1993 | Eklund et al. |
| 5,268,076 | A | 12/1993 | Best et al. |
| 5,328,757 | A | 7/1994 | Kenney et al. |
| 5,360,656 | A | 11/1994 | Rexfelt et al. |
| 5,864,931 | A | 2/1999 | Best et al. |
| 6,140,260 | A | 10/2000 | Johnson et al. |
| 6,159,880 | A | 12/2000 | Schiel |
| 6,171,446 | B1 | 1/2001 | Diaz-Kotti |
| 6,592,636 | B1 | 7/2003 | Joyce |
| 6,616,812 | B1 | 9/2003 | Beck |

FOREIGN PATENT DOCUMENTS

| | | | |
|---|---|---|---|
| GB | 2 332 916 | | 7/1999 |
| JP | 2 992 767 | | 12/1999 |
| JP | 2005256227 | | 9/2005 |
| WO | WO 99/32715 | * | 7/1999 |
| WO | WO 01/27387 | | 4/2001 |
| WO | WO 03/023106 | | 3/2003 |

OTHER PUBLICATIONS

Morrison, R.E. 1969. *Felt Capillary Struture and Water Removal*. Pulp and paper Magaine, vol. 70, No. 3 (Feb. 1969), pp. 58-62.

Wahlstrom, B. 1969. *Our Present Understanding of the Fundamentals of Pressing*. Abbreviated from Pulp & Paper Magazine of Canada, vol. 70, No. 10 (Oct. 3, 1969), pp. 76-96.

Wiseman, Nick. *The Effect of Felt Properties on the Pressing of Paper*. Pulp and Paper Canada, vol. 77, No. 9 (Sep. 1978), pp. T149-T153.

Bliesner, William C. 1978. *Sheet Water Removal In a Press: the Role of Wet Felt Properties*. Paper, vol. 52, No. 11 (Oct. 1978), pp. 76-79.

Beck, David A. 1986. *Re-examing Wet Pressing Fundamentals: a Look Inside the Nip Using Dynamic Measurement*. From Proceedings TAPPI Engineering Conference (Atlanta, GA: Sep. 22-25, 1986), Book 1, pp. 105-115.

Palokangas, Antti. 1990. *Press Felt to Increase Dryness by Avoiding Rewetting*. Paper presented at Modern Technologies in Pressing and Drying, Pira, (Bournemouth, UK, Nov. 6-8, 1990, vol. 1), 8 pp.

Talja, R.; Honkalampi, P. 1994. *Compressibility and Flow Resistance of Porous Medium*. Paper presented at 80th Annual Meeting Technical Section, Canadian Pulp and Paper Association (Montreal, QC, Feb. 1-2, 1994), Preprints A, pp. A187-A190.

Antos, Dave. 1995. *Paper Machine Clothing Developments Aimed at Increased Production and Quality*, Paper Age, (Jun. 1995), pp. 10-14.

Mercer, Colin, 1998. *Use of Membrane Composites in Press Felts Enhance Pressing Efficiency*. Paper presented at 84th Annual Meeting Technical Section, Canadian Pulp and Paper Association (Montreal, QC, Jan. 27-30, 1998), Preprints B, pp. B197-B204.

Shidara, Toyohisa. 2000. *Roles of press felt in press section of paper machine—dewatering mechanism and felt design*. Japan Tappi Journal, vol. 54, No. 5 (May 2000), pp. 22-28.

Patterson, B. 2003. *Enhanced Water Removal Pressing*. Paper presented at 89th Annual Meeting Technical Section, Pulp and Paper Technical Association of Canada, (Montreal, QC, Canada, Jan. 27-30, 2003), session 4B-2, 5 pp. Montreal, Canada.

* cited by examiner

PRESS FELT WITH IMPROVED DEWATERING CAPABILITY

CROSS-REFERENCE TO RELATED APPLICATIONS

The present application claims the benefit of U.S. Provisional Application No. 60/532,194, filed on Dec. 23, 2003, which is incorporated by reference herein as if fully set forth.

BACKGROUND

The present invention relates to an improved press felt for use on a papermaking machine. More particularly, the invention relates to press felts that incorporate, as a component of the batt materials attached to one or both sides of the base fabrics of the felts, from about 20% to about 100% by weight of regenerated cellulosic staple fibers in at least one of the layers of batt material in order to improve the dewatering capability of the felt.

Press felts are endless belts which may contain a seam and which are used to convey an embryonic paper web from the forming section, through the press and into the dryer section of a papermaking machine so as to dewater and ultimately dry the paper product so that it is suitable for use. In the press section, at least one press nip is typically provided between either a pair of rotating cylindrical rollers, or a roller and concave shoe. The embryonic paper web passes through the at least one press nip laid either upon a single felt, or sandwiched between at least two press felts. As the web passes through the at least one press nip, water is expressed from it and passes into the at least one press felt.

Papermaker's press felts are well known. See, for example, U.S. Pat. No. 4,199,401 to Liu et al., U.S. Pat. No. 4,356,225 to Dufour, U.S. Pat. No. 4,414,263 to Miller et al., U.S. Pat. No. 4,806,413 to Penven, U.S. Pat. No. 5,360,656 to Rexfelt et al., and U.S. Pat. No. 5,864,931 to Best et al. These felts are usually comprised of a woven base fabric (typically formed of nylon or similar polymeric yarns) to which is attached, generally by needling, at least one layer of a pre-tacked staple fiber web, commonly referred to as a batt. Typical press felt batts will usually include between one and about 5 or more layers of a pre-tacked staple fiber web needled onto a first planar surface of the base fabric (usually the surface which, when in use, will be in contact with the paper sheet, and is hereafter referred to as the "PS") to form a PS batt, and from none to one or more layers needled to the opposite planar surface (which when in use will be in contact with the equipment of the paper machine, and is hereafter referred to as the "MS") to form the MS batt. The staple fibers used to form either or both the MS and PS batt are typically made from one or more nylons, polyesters or other polymeric materials such as are commonly employed in the manufacture of industrial textiles.

The batt provides a smooth surface for the paper web and a void volume into which water, which has been expressed from the paper web at the press nip, can be received. The base fabric provides some additional void volume, as well as a stable structure to which the batt can be attached. The base fabric is typically comprised of interwoven polymeric monofilament or multifilament yarns to which the batt is attached, generally by needling or other entanglement process such as is known in the art.

After the paper web has been pressed in at least one nip in the press section, it will still contain an appreciable amount of water, as much as from 30% to about 60% or more by weight. This remaining water must now be removed in the dryer section of the papermaking machine in order to provide a paper product. The final drying of the paper product is typically carried out by evaporative means, which requires a large amount of energy. This adds substantially to the cost of manufacturing the paper product. Generally, a 1% increase in the dryness of the sheet exiting the press section will translate into about a 4% energy savings in the dryer section. It is also possible that the speed of the paper machine may have to be reduced or at least limited due to the evaporative capacity of the dryer section.

Thus, it would be highly desirable if the water removal characteristics of the press felts could be improved so as to increase the amount of water they are capable of transporting away from the paper product as it passes through the press section.

It has been known to use regenerated cellulosics such as rayon as a component of papermaking fabric batt materials. However, such use has generally been restricted to certain specific circumstances. One know application provided an article of paper machine clothing for a press section of an impulse drying machine having a paper contacting surface layer which included a thermal barrier with sheet release properties, a base structure layer, and at least one intermediate layer. This intermediate layer could include fine denier fibers and/or hydrophilic fibers such as wool, cotton and regenerated cellulosics. Fabrics constructed in this manner and evaluated on a pilot scale impulse drying machine operating at 205° C. were reported to have achieved 4 to 5 percentage points of added dryness in the sheet. However, the intermediate layer was heat shielded, and the improved drying appears to have been mainly due to the high drying temperature of about 205° C. This was a press fabric for use at temperatures well above the normal operating temperature range of press sections, which typically run between about 40° C. and about 80° C., and clearly involved a different application.

Another known felt included a so-called "flow control" layer located between the batt and base to "impede rewetting of the paper web" as it exits the press nip. This flow control layer was reported to be formed of a spunbonded filamentary nylon material which is noncircular in cross-section (such as trilobal). It was also noted that the flow control layer could be formed from various materials, including rayon. However, a hydrophobic treatment was imparted to the flow control layer to prevent water absorption.

Another known press felt has been reported that includes a high proportion of fibrillatable fibers located in at least the PS surface of the batt so as to provide a relatively fine sheet supporting surface for the paper web. The PS surface was indicated as being formed from fibers which are as fine as possible (below 1 denier in size). These fine fibers occur as a result of the fibrillation of relatively larger regenerated cellulosic fibers (e.g. >1 denier in size) due to hydroentanglement or mechanical pressure.

A transfer fabric has also been known that includes a base structure and a fiber batt layer which is impregnated with a polymer matrix. The batt fibers differ from one another with respect to their surface properties so that the PS surface of the belt facing the web has both hydrophilic and hydrophobic areas.

The vast majority of press felts which are manufactured for, and are in use in paper mills today, consist of 100% nylon staple fiber in at least the batt, mainly due to its abrasion resistance, resiliency and tenacity.

SUMMARY

In accordance with the present invention, it has been determined that, by incorporating at least about 20% by weight of a regenerated cellulosic product, in particular viscose rayon, in the batt of a press felt, it is possible to achieve an improvement of from about 3% to about 8%, or more, in the felt's dewatering capability when compared to an equivalent felt which lacks the regenerated cellulosic fibers.

Further, in accordance with the invention it is possible to incorporate a woven mesh comprised of regenerated cellulosic, or a nonwoven scrim of the same material, into virtually any position in the batt stratification, but preferably relatively near the paper side surface of the batt, and still obtain similar improvements in dewatering.

Thus, the present invention seeks to provide an improved press felt, which is comprised of a base fabric layer to which one or more layers of batt material is attached, generally by needling or other known techniques. The preferred batt material includes at least two differing types of fibers. The first type is a regenerated cellulose material, such as viscose rayon, while the second type is a polymeric fiber, such as nylon.

The different types of fiber are blended together, preferably in a ratio of from 20% to 100%:80% to 0% ratio (cellulosic to polymeric) by weight. In one preferred embodiment, a 50:50 ratio is utilized.

Preferably, the fibers are from about 1 dtex to about 44 dtex or more in size, and have a length of about 1–2 inches (2.5–5 cm). More preferably, the fibers are about 3–15 dtex in size and are blended together with the polymeric staple fibers to form a pre-tacked batt by carding and needling in a manner well known in the art. It is also contemplated that the fiber types may have differing sizes without this difference materially affecting the dewatering properties of the batt and resulting felt. For example, the regenerated cellulosic staple fibers may have a dtex of about 3 while the other fiber may be in the range of from 5–7 dtex, or more.

According to the invention, it has also been found that it is not necessary to restrict the use of the regenerated cellulosic fibers to one layer or location in the batt. Comparable dewatering performance may be obtained when 50%:50% by weight ratio blends of nylon and viscose rayon staple fiber are incorporated into all layers of the batt. Preferably, however, the 50%:50% by weight ratio blend of cellulosic and polymeric materials is located on the paper side surface of the batt, closest to the sheet. When a roughly 50%:50% by weight ratio blend of the regenerated cellulosic fibers is combined with polymeric fibers of roughly the same size (such as nylon-6), the abrasion resistance of the resulting batt is about equal to that of a batt formed entirely from 100% nylon-6 materials. The regenerated cellulosic staple fiber component appears to help to reduce shedding of batt fibers during normal operation of the press felt, thus extending fabric service life. A blend of polymeric and cellulosic fibers also promotes improved fiber anchoring of the batt fibers to the base fabric, batt tenacity and uniformity.

In another aspect, the present invention provides a felt comprising a base fabric layer to which is attached at least one layer of batt material. A mesh or nonwoven scrim comprised of from about 20 to about 80% by weight of regenerated cellulosic fibers and polymeric fibers is located either between the base layer and the at least one layer of batt material, or between any two layers of batt material.

In another aspect, the press felt according to the present invention is formed with a base fabric comprised of a nonwoven scrim. This nonwoven base fabric preferably includes at least some regenerated cellulosic fibers to enhance the dewatering capability of the press felt. One or more layers of batt material which also include regenerated cellulosic staple fibers are needled to the nonwoven base fabric in order to form the press felt.

In another aspect of the invention, the base fabric is a woven fabric layer in which at least one of the CD or MD yarn systems comprises multifilament yarns that include a regenerated cellulosic material in order to enhance the press felt dewatering performance.

DETAILED DESCRIPTION OF THE PREFERRED EMBODIMENTS

Figure 1:
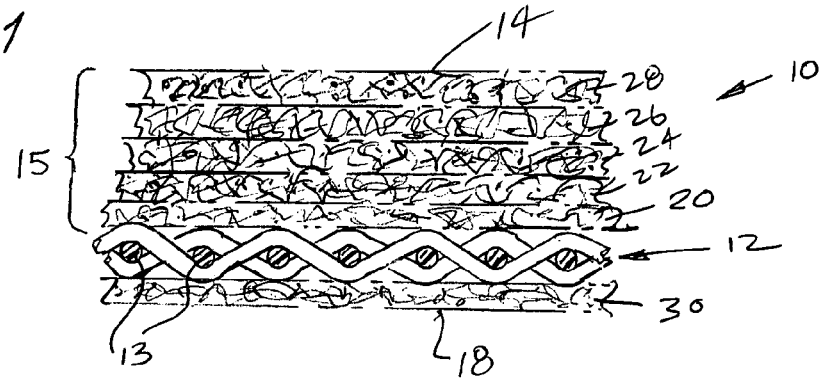
FIG. 1 is a schematic cross-section of a press fabric being constructed in accordance with the teachings of the invention.

Certain terminology is used in the following description for convenience only and is not considered limiting. Words such as "up", "down", "top", and "bottom" designate direction in the drawings to which reference is made. This terminology includes the words specifically noted above, derivatives thereof and words of similar input. Additionally, the terms "a" and "one" are defined as including one or more of the referenced data unless specifically noted. The following abbreviations are also used herein: MS—"machine side"; PS—"paper side"; MD—"machine direction"; and CD—"cross direction". As used herein, "scrim" is defined as a light weight woven or nonwoven textile such as a mesh or a similar fabric.

Figure 2:
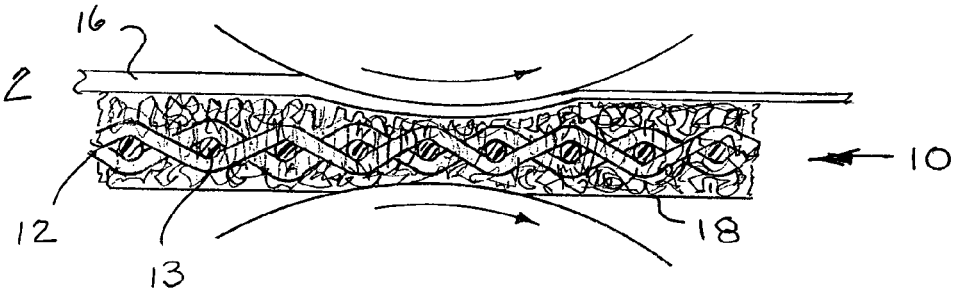
FIG. 2 is a cross-sectional view showing the press fabric with a paper web being formed thereon passing through the nip of two press rolls in the press section of a papermaking machine.

Referring to FIG. 1, a press felt 10 for use in the press section of a papermaking machine in accordance with the present invention is schematically illustrated. The press felt 10 includes a base fabric layer 12 and at least one layer of a staple fiber batt 20 connected to the base fabric layer 12. The press felt has a paper side surface (PS) 14 which when in operation is in contact with the paper web 16, as shown in FIG. 2, and a machine side surface (MS) 18 which contacts various press section components, such as the lower press roll shown in FIG. 2.

Preferably, the at least one layer of staple fiber batt 15 which comprises a plurality of layers of staple fiber batt material 20, 22, 24, 26, 28 located on the PS of the base fabric 12. One or more layers of staple fiber batt material 30 may also be located on the MS of the base fabric 12, as shown in FIG. 1. The staple fiber batt material is preferably comprised of between 20% to 100% by weight of a regenerated cellulosic staple fiber and from 80% to 0% by weight of a polymeric staple fiber. These staple fiber batt material layers are preferably carded into batt layers having a desired density and connected to the base fabric layer 12 by a needling process of the type known in the art. Preferably, at least one or more of the staple fiber batt material layers 20, 22, 24, 26, 28 are comprised of between 20% to 100% by weight of the regenerated cellulosic staple fiber and from 80% to 0% by weight of the polymeric staple fabric. More preferably, the one or more of the staple fiber batt material layers 20, 22, 24, 26, 28 is comprised of between 50% to 80% by weight on the regenerated cellulosic staple fabric and from 50% to 20% by weight of polymeric staple fabric. In a most preferred embodiment which has been subject to extensive testing, the staple fiber batt material layers 20, 22, 24, 26, 28 are each comprised of about 50% by weight of the regenerated cellulosic staple fabric and about 50% by weight of the polymeric staple fabric. The separate layers of staple fiber batt material 20, 22, 24, 26, 28 are represented in FIG. 1 prior to needling where the distinct layers can be seen. After needling, as shown in FIG. 2, a uniform more dense press felt is formed with the fibers of the at least one layer of the staple fiber batt 15 being anchored into the base fabric through the needling process.

In the preferred embodiment, the regenerated cellulosic staple fiber in the staple fiber batt material layers 20, 22, 24, 26, 28 has a dtex from at least about 1 to about 44. When a plurality of layers of staple fiber batt material 20, 22, 24, 26, 28 are utilized, as shown in FIG. 1, it is preferred that the regenerated cellulosic staple fiber in the layer of staple fiber batt 28 located on the PS of the press felt 10 has a smaller size than the staple fiber of batt material of an intermediate layer of the staple fiber batt material 20, 22 adjacent to the base fabric. In one preferred embodiment, the regenerated cellulosic staple fibers in the PS batt layers 26, 28 have a dtex of about 2 to about 6 and the regenerated cellulosic fibers of the intermediate batt layer 20, 22 have a dtex of 8 to about 20. While these regenerated cellulosic staple fiber sizes have proven successful, applicants have also achieved improvements in dewatering by way of utilizing regenerated cellulosic staple fibers of the same size in each of the layers of staple fiber batt material 20, 22, 24, 26, 28. Accordingly, the sizes can be adjusted based on the particular application.

Preferably, when the plurality of staple fiber batt material layers 20, 22, 24, 26, 28 are used, all of the PS batt layers 15 are comprised of a blend of from about 20% to about 100% by weight as the regenerated cellulosic staple fiber and from about 80% to about 0% by weight of the polymeric stable fiber. It has been found that by providing a uniform mix of the regenerated cellulosic staple fibers throughout the batt material layers, better dewatering results are obtained. However, it would also be possible to provide one or more of the intermediate layers formed entirely of a polymeric staple fiber near or adjacent to the base fabric 12, if desired.

It has been found in connection with the invention that if the regenerated cellulosic staple fibers and the polymeric staple fiber yarns have too small of a size, the performance of the fabric may be compromised. Accordingly, in the most preferred embodiments of the invention, the regenerated cellulosic staple batt fibers have a dtex of at least 3.

In a preferred embodiment of the invention, at least a portion of the regenerated cellulosic staple fibers are located at or near the PS 14 of the press felt 12. In this embodiment, the PS staple fiber batt material layers 26, 28 generally comprise a uniform distribution of the regenerated cellulosic staple fibers with the polymeric staple fiber. This blending can take place through mixture of the staple fibers prior to the fibers being carded to form the batts. In one preferred embodiment the polymeric staple fibers and the regenerated cellulosic staple fibers have approximately an equal size. For example, both the regenerated cellulosic staple fibers and the polymeric staple fibers have a dtex of from about 3 to about 6.

The regenerated cellulosic staple fiber material is preferably viscose rayon, and may be solid, hollow or otherwise shaped, such as Viloft® available from Courtaulds. It has been found in experimental trials that regenerated cellulosic fibers which are resistant to fibrillation are preferred for this use. Polymeric staple fibers comprised of polypropylene, polyethylene terephthalate and the like, may be suitable for blending in the present invention.

Preferably, the regenerated cellulosic staple fibers are Merge 8142 viscose rayon having a dtex of about 3.3 available in about 2 inch lengths from Lenzing Fiber Corp. of Charlotte, N.C. Similar viscose rayon staple fibers may provide comparable results.

Preferably, the polymeric fiber is comprised of one or more of nylon 6, nylon 6/6, nylon 6/10, nylon 6/11 or nylon 6/12. Alternatively, it may comprise of one of polypropylene (PP), polyethylene terephthalate (PET) or other polymeric fiber materials such as commonly used in industrial textiles. Preferably, the dtex of both is at least about 3, and the regenerated cellulosic staple fiber is viscose rayon. Even more preferably, the regenerated cellulosic fiber is non-fibrillatable. Optionally, the regenerated cellulosic fiber is flame retardant to assist with processing.

In a preferred embodiment, the staple fiber batt material includes a melt fusible polymeric bi-component staple fiber. This allows the batt material to not only be anchored to the base fabric 12 by needling but also allows heat treatment of the fabric to further lock the fibers of the staple fiber batt material in place to reduce shedding.

Preferably, a weight of the regenerated cellulosic staple fiber in the staple fiber batt material 15 in the press felt 10 is from about 75 to about 1000 gsm (grams per square meter). More preferably, a weight of the regenerated cellulosic staple fiber in the staple fiber batt material 15 in the press felt 10 is about 300 to about 700 gsm. In a most preferred embodiment of the invention, a weight of the regenerated cellulosic fiber in the staple fiber batt material 15 for the press felt 10 is from about 350 to about 700 gsm. This weight is preferably achieved by providing multiple layers of staple fiber batt material 20, 22, 24, 26, 28 on the PS 14 of the base fabric 12.

Additionally, one or more layers of staple fiber batt material 30 which may be comprised of polymeric fibers and/or regenerated cellulosic staple fibers is/are provided on the MS 18. the weight of each of these layers is typically in the range of 50 to 100 gsm. By constructing the felt with multiple layers of staple fiber batt material 20, 22, 24, 26, 28 and 30, further variations in construction can be obtained such as varying the dtex of staple fiber batt material in the PS layers 26, 28 in comparison to the intermediate layers 20, 22, 24. However, it is preferred that each of the PS layers include some of the cellulosic staple fiber batt material.

In accordance with another aspect of the invention, further improvements in dewatering can be obtained wherein at least a portion of the base fabric 12 includes multi-filaments comprised of viscose rayon. These multi-filaments are preferably comprised of a mix of polymeric materials, such as nylon, PET or other suitable polymeric materials with the viscose rayon. Alternatively, at least a portion of the base fabric 12 can include spun yarns 13, at least a portion of the spun yarns being comprised of the regenerated cellulosic fibers, such as viscose rayon. These can be woven into the base fabric 12 in the known manner and provide for further dewatering capability of the press felt 10 without a reduction in strength. While the base fabric 12 is preferably a woven fabric, it is also possible to use a nonwoven fabric as the base fabric which comprises polymeric fibers and regenerated cellulosic staple fibers.

Figure 3:
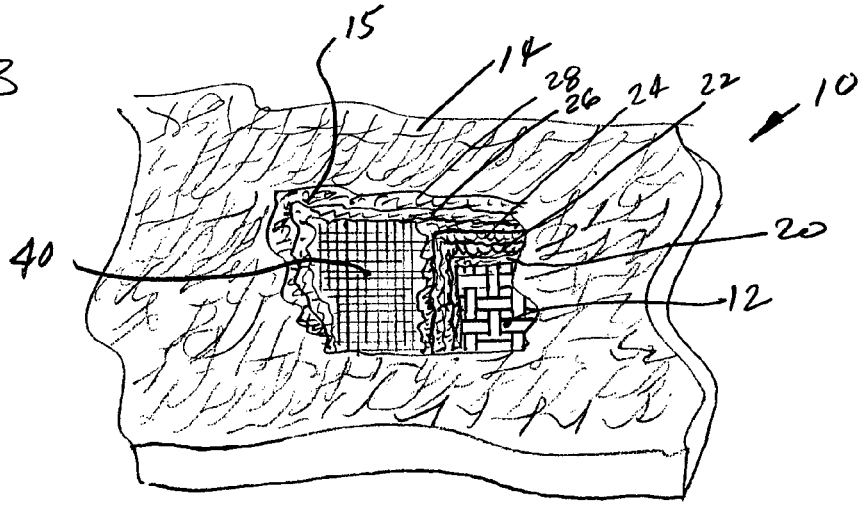
FIG. 3 is a top view, partially broken away, of a press fabric in accordance with another embodiment of the having a scrim incorporated into the PS batt layers.

As shown in FIG. 3, a scrim 40 of the regenerated cellulosic material can be incorporated into the layers of staple fiber batt material 20, 22, 24, 26, 28 and 30 on the PS or MS of the base fabric 12, or between the layers of staple fiber batt material 20, 30 adjacent to the base fabric 12 and the base fabric 12. The scrim 40 can be formed of a woven or nonwoven material, and can be oriented in any direction with respect to the CD and MD. For example, the scrim can be arranged at 0° or 90°, generally parallel to the base fabric, or can be arranged at an angle of 45° with respect to the MD and CD. If the scrim is spirally wound into the felt, it can be at an angle of 1° to 10° with respect to the MD.

Additionally, the base fabric 12 can include regenerated cellulosic material incorporated into the MD and/or CD yarns of the base fabric itself.

In accordance with the invention, further improvements in reducing rewetting of the paper web 16 after it has passed through the nip of the press rolls are provided if a hydrophobic surface treatment is applied to the PS of the batt layers 15 or to at least a portion of the regenerated cellulosic staple fibers in the staple fiber batt material layers 20, 22, 24, 26, 28, such as by coating the stable fibers prior to assembly of the batt layers. While this appears counterintuitive, it is believed that improved capillary action for removing water from the PS of the press felt 10 results from the hydrophobic treatment. In testing conducted on press felts in accordance with the invention, hydrophobic treatment resulted in approximately 1% better moisture removal from the paper web 16.

Experimental Trials

An experimental trial was conducted at a paper mill to determine the dewatering capacity and performance characteristics of a felt constructed in accordance with the teachings of the present invention. The press felt consisted of two layers of abase fabric whose basis weight was about 600 gsm (grams per square meter), to which 5 layers of a 75 gsm basis weight, 10 dtex nylon batt material having a basis weight of about 375 gsm (i.e.: 5×75 gsm) was needled; a further 4 layers of 3.3 dtex fiber batt material consisting of a blend of about 50% by weight nylon-6 and about 50% by weight of viscose rayon material was needled onto the outer most of this first 5 layers. The viscose rayon was Merge 8142 available from Lenzing Fibers Corp. of Charlotte, N.C. The felt was assembled using normal industrial textile assembly methods consistent with the manufacture of papermakers' press felts and then installed in the first press position (i.e. the press closest to the forming section) of a papermaking machine. A control felt, which did not include any regenerated cellulosic fibers in the batt, was run the day before the experimental installation. The machine was run at a speed of about 2,750 fpm (feet per minute). The experimental and control fabrics were exposed to identical physical conditions of furnish, temperature, machine speed, etc.

The consistency of the sheet was measured immediately downstream of the press nip in the center of the sheet. Measurements were made by means of "grab sampling" portions of the pressed sheet whereby a metal cup was used to remove a sample of the sheet immediately following the first press nip. The samples were each weighed, then oven dried and weighed again to determine their moisture content. We found that, on average, the control felt provided about 42.3% consistency as compared to 46.8% consistency for the trial felt. This represents an improvement in sheet consistency following the nip of 4.5%. The consistency was measured at normal operating temperatures, between 40 and 80 degrees C., for the press environment.

TABLE 1

Laboratory Trials

| Sample No. | Fabric Construction | % Consistency | Improvement |
|---|---|---|---|
| | Trial # 1 | | |
| N161 | PS: 150 gsm 3.3 dtex nylon batt<br>PS: 8 layers 50 gsm Rayon Scrim<br>2 layers spirally wound woven polymeric base fabric<br>MS: 1 layer 100 gsm 6.7 dtex nylon batt | 54.40% | na |
| | Trial # 2 | | |
| N167A | PS: 150 gsm 3.3 dtex nylon batt<br>PS: 2 layers 50 gsm Rayon scrim<br>PS: 200 gsm 15 dtex nylon batt<br>2 layers spirally wound woven polymeric base fabric<br>MS: 1 layer 100 gsm 15 dtex nylon batt | 46.20% | |
| | | | 1.50% |
| N167B Control | PS: 150 gsm 3.3 dtex nylon batt<br>PS: 3 layers 100 gsm 15 dtex nylon batt<br>2 layers spirally wound woven polymeric base fabric<br>MS: 1 layer 100 gsm 15 dtex nylon batt | 44.70% | |
| | Trial # 3 | | |
| N169A | PS: 150 gsm 3.3 dtex nylon batt<br>PS: 4 layers 50 gsm Rayon scrim<br>PS: 200 gsm 15 dtex nylon batt<br>2 layers spirally wound woven polymeric base fabric<br>MS: 1 layers 100 gsm 15 dtex batt | 50.60% | |
| | | | 6.00% |
| N169B Control | PS: 150 gsm 3.3 dtex nylon batt<br>PS: 3 layers 100 gsm 15 dtex nylon batt<br>2 layers spirally wound woven polymeric base fabric<br>MS: 1 layer 100 gsm 15 dtex nylon batt | 44.60% | |
| | Trial # 4 | | |
| N171A | PS: 180 gsm 1.7 dtex nylon batt<br>PS: 4 × 50 gsm Rayon scrim<br>PS: 200 gsm 15 dtex nylon batt | 53.40% | |

TABLE 1-continued

| Laboratory Trials | | | |
|---|---|---|---|
| Sample No. | Fabric Construction | % Consistency | Improvement |
| | 2 layers spirally wound woven polymeric base fabric<br>MS: 1 layer 100 gsm 15 dtex nylon batt | | |
| | | | 7.10% |
| N171B Control | PS: 150 gsm 3.3 dtex nylon batt<br>PS: 300 gsm 15 dtex nylon batt<br>2 layers spirally wound woven polymeric base fabric<br>MS: 1 layer 100 gsm 15 dtex nylon batt | 46.30% | |
| | Trial # 5 | | |
| N192A | PS: 150 gsm 3.3 dtex nylon batt<br>PS: 100 gsm Hand Carded 3.3 dtex Rayon<br>PS: 300 gsm 15 dtex nylon batt<br>2 layers spirally wound woven polymeric base fabric<br>MS: 100 gsm 15 dtex nylon batt | 52.00% | |
| | | | 6.90% |
| N192B Control | PS: 150 gsm 3.3 dtex nylon batt<br>PS: 100 gsm 15 dtex nylon batt<br>PS: 300 gsm 15 dtex nylon batt<br>2 layers spirally wound woven polymeric base fabric<br>MS: 100 gsm 15 dtex nylon batt | 45.10% | |
| N192C Control | PS: 150 gsm 3.3 dtex nylon batt<br>PS: 100 gsm 3.3 dtex nylon batt<br>PS: 300 gsm 15 dtex nylon batt<br>2 layers spirally wound woven polymeric base fabric<br>MS: 100 gsm 15 dtex nylon batt | 48.50% | 3.50% |
| | Trial # 6 | | |
| N192E | PS: 150 gsm 3.3 dtex nylon batt<br>PS: 300 gsm carded 3.3 dtex Rayon<br>PS: 100 gsm 15 dtex nylon batt<br>2 layers spirally wound woven polymeric base fabric<br>MS: 100 gsm 15 dtex nylon batt | 55.00% | |
| | | | 5.90% |
| N192F Control | PS: 150 gsm 3.3 dtex nylon batt<br>PS: 300 gsm 3.3 dtex nylon batt<br>PS: 100 gsm 15 dtex nylon batt<br>2 layers spirally wound woven polymeric base fabric<br>MS: 100 gsm 15 dtex nylon batt | 49.10% | |
| | Trial # 7 | | |
| N193 | PS: 150 gsm 3.3 dtex nylon batt<br>PS: 300 gsm carded 1.3 dtex Rayon<br>PS: 100 gsm 15 dtex nylon batt<br>2 layers spirally wound woven polymeric base fabric<br>MS: 100 gsm 15 dtex nylon batt | 55.20% | |
| | | | 2.50% |
| N193B Control | PS: 150 gsm 3.3 dtex nylon batt<br>PS: 270 gsm 1.7 dtex Grilon M369 nylon<br>PS: 100 gsm 15 dtex nylon batt<br>2 layers spirally wound woven polymeric base fabric<br>MS: 100 gsm 15 dtex nylon batt | 52.70% | |
| | Trial # 8 | | |
| N194A | PS: 150 gsm 3.3 dtex nylon batt<br>PS: 150 gsm carded 3.3 dtex Rayon<br>PS: 200 gsm 15 dtex nylon batt<br>2 layers spirally wound woven polymeric base fabric<br>MS: 100 gsm 15 dtex nylon batt | 52.40% | |
| | | | 5.40% |
| N194B Control | PS: 150 gsm 3.3 dtex nylon batt<br>PS: 150 gsm 3.3 dtex nylon<br>PS: 200 gsm 15 dtex nylon batt<br>2 layers spirally wound woven polymeric base fabric<br>MS: 100 gsm 15 dtex nylon batt | 47.00% | |
| | Trial # 9 | | |
| N195A | PS: 150 gsm 3.3 dtex carded rayon fiber<br>PS: 150 gsm 3.3 dtex nylon batt<br>PS: 200 gsm 15 dtex nylon batt<br>2 layers spirally wound woven polymeric base fabric<br>MS: 100 gsm 15 dtex nylon batt | 51.60% | |
| | | | 5.80% |
| N195B Control | PS: 150 gsm 3.3 dtex nylon batt<br>PS: 150 gsm 3.3 dtex nylon batt<br>PS: 200 gsm 15 dtex nylon batt<br>2 layers spirally wound woven polymeric base fabric | 45.80% | |

TABLE 1-continued

| Laboratory Trials | | | |
|---|---|---|---|
| Sample No. | Fabric Construction | % Consistency | Improvement |
| | MS: 100 gsm 15 dtex nylon batt<br>Trial # 10 | | |
| N196A | PS: 200 gsm 6.7 dtex nylon<br>PS: 300 gsm 3.3 dtex carded rayon fiber<br>2 layers spirally wound woven polymeric base fabric<br>MS: 100 gsm 15 dtex nylon batt | 52.80% | |
| | | | 3.60% |
| N196B Control | PS: 200 gsm 6.7 dtex nylon<br>PS: 300 gsm 3.3 dtex nylon batt<br>PS: 100 gsm 15 dtex nylon batt<br>2 layers spirally wound woven polymeric base fabric<br>MS: 100 gsm 15 dtex nylon batt<br>Trial # 11 | 49.20% | |
| N197A | PS: 300 gsm 3.3 dtex carded rayon fiber<br>PS: 300 gsm 15 dtex nylon<br>1 layer spirally wound polymeric base fabric (Prizm XF Base 705)<br>1 layer full width woven base (Maxxum Base 107) | 55.20% | |
| | | | 8.00% |
| N197B Control | PS: 300 gsm 3.3 dtex carded nylon staple fiber<br>PS: 300 gsm 15 dtex nylon<br>1 layer spirally wound polymeric base fabric (Prizm XF Base 705)<br>1 layer full width woven base (Maxxum Base 107)<br>Trial # 12 | 47.20% | |
| N198A | PS: 75 gsm 3.3 dtex nylon<br>PS: 300 gsm 3.3 dtex carded rayon staple fiber<br>PS: 300 gsm 15 dtex nylon<br>2 layers spirally wound woven polymeric base fabric<br>MS: 100 gsm 15 dtex nylon batt<br>Trial # 13 | 58.10% | na |
| No. 4018101 Full size production trial | PS: 300 gsm 50/50 blend of 3.3 dtex rayon and nylon staple fibers<br>PS: 375 gsm 11 dtex nylon staple fiber batt | 54.20% | |
| | 1 layer spirally wound polymeric base fabric (Prizm XF Base 705)<br>1 layer full width woven base (Maxxum Base 107) | | |
| | | | 7.00% |
| Full size production control | PS: 300 gsm 3.3 dtex nylon staple fiber | | |
| | PS: 300 gsm 15 dtex nylon staple fiber<br>1 layer spirally wound polymeric base fabric (Prizm XF Base 705)<br>1 layer full width woven base (Maxxum Base 107)<br>Trial # 14 | 47.20% | |
| N203A | PS: 75 gsm 3.3 dtex nylon staple fiber<br>PS: 300 gsm 50/50 blend of 3.3 dtex rayon and nylon staple fibers<br>PS: 200 gsm 15 dtex nylon staple fiber<br>2 layers spirally wound woven polymeric base fabric<br>MS: 100 gsm 15 dtex nylon batt | 53.00% | |
| | | | 5.80% |
| N203B Control | PS: 75 gsm 3.3 dtex nylon staple fiber<br>PS: 300 gsm 3.3 dtex nylon staple fiber<br>PS: 200 gsm 15 dtex nylon staple fiber<br>2 layers spirally wound woven polymeric base fabric<br>MS: 100 gsm 15 dtex nylon batt<br>Trial # 15 | 47.20% | |
| Full size production trial | PS: 300 gsm 50/50 blend of 3.3 dtex rayon and nylon staple fiber | | |
| | PS: 375 gsm 11 dtex nylon staple fiber batt<br>1 layer spirally wound polymeric base fabric<br>1 layer full width woven base | 46.80% | |

While the preferred embodiments of the invention have been described in detail, the invention is not limited to these specific embodiments described above which should be considered as merely exemplary. Further modifications and extensions of the present invention may be developed and all such modifications are deemed to be within the scope of the present invention as defined by the appended claims.

The invention claimed is:

1. A press felt for use in the press section of a papermaking machine, the press felt comprising:

a base fabric layer and at least one layer of a staple fiber batt material connected to the base fabric layer, the press felt having a paper side surface (PS) which when in operation is in contact with a paper web conveyed thereon and a machine side surface (MS) which contacts various press section components, the staple fiber batt material is comprised of between 20% to 80% by weight of a non-fibrillatable regenerated cellulosic staple fiber consisting of fibers with a size of at least about 1.1 dtex to 44 dtex, and from 80% to 20% by weight of a polymeric staple fiber.

2. A press felt according to claim 1, wherein the staple fiber batt material comprises a generally uniform physical distribution of the regenerated cellulosic staple fibers with the polymeric staple fiber.

3. A press felt according to claim 2, wherein the polymeric staple fibers and the regenerated cellulosic staple fibers have an approximately equal size.

4. A press felt according to claim 2 wherein the polymeric staple fiber yarn is nylon.

5. A press felt according to claim 2, wherein the staple fiber batt material is comprised of between 50% to 80% by weight of the regenerated cellulosic staple fiber and from 50% to 20% by weight of the polymeric staple fiber.

6. A press felt according to claim 2, wherein the staple fiber batt material is comprised of about 50% by weight of the regenerated cellulosic staple fiber and about 50% by weight of the polymeric staple fiber.

7. A press felt according to claim 1, wherein the at least one layer of the staple fiber batt material comprises a plurality of layers of staple fiber batt material, the regenerated cellulosic staple fiber in the layer of staple fiber batt material on the PS of the press felt having a smaller size than the staple fiber batt material of an intermediate layer of the staple fiber batt material adjacent to the base fabric.

8. A press felt according to claim 7, wherein the regenerated cellulosic staple fibers in the paper support surface batt layer have a dtex of about 2 to about 6, and the regenerated cellulosic fibers of the intermediate batt layer have a dtex of about 8 to about 20.

9. A press felt according to claim 1, wherein the staple fiber batt material is connected to the base fabric layer by a needling process.

10. A press felt according to claim 1, wherein a weight of the regenerated cellulosic fiber in the staple fiber batt material in the press felt is from about 75 to about 1000 gsm (grams per square meter).

11. A press felt according to claim 1, wherein a weight of the regenerated cellulosic fiber in the staple fiber batt material in the press felt is from about 300 to about 700 gsm.

12. A press felt according to claim 1, wherein a weight of the regenerated cellulosic fiber in the staple fiber batt material for the press felt is from about 350 to about 700 gsm.

13. A press felt according to claim 1, wherein the regenerated cellulosic staple fiber is viscose rayon.

14. A press felt according to claim 1, wherein the at least one layer of staple fiber batt material comprises a plurality of layers, and all of the PS batt layers are comprised of a blend of from about 20% to about 80% by weight of the regenerated cellulosic staple fiber and from about 80% to about 20% by weight of a polymeric staple fiber yarn.

15. A press felt according to claim 14, wherein the polymeric staple fiber yarn is comprised of one or more of nylon 6, nylon 6/6, nylon 6/10, nylon 6/11 or nylon 6/12.

16. A press felt according to claim 1, wherein at least a portion of the base fabric includes multifilaments, at least a portion of which multifilaments are comprised of viscose rayon.

17. A press felt according to claim 1, wherein at least a portion of the base fabric includes spun yarns, at least a portion of said spun yarns are comprised of viscose rayon.

18. A press felt according to claim 1, wherein the base fabric layer is either a woven or nonwoven fabric, and comprises polymeric fibers and a regenerated cellulosic staple fibers.

19. A press felt according to claim 1, further comprising a hydrophobic surface treatment to at least one of the regenerated cellulosic staple fibers and the press felt.

20. A press felt according to claim 1, wherein the regenerated cellulosic staple batt fibers have a dtex of at least 3.

21. A press felt according to claim 1, wherein the staple fiber batt material includes a melt fuseable polymeric bicomponent staple fiber.

* * * * *